US007402045B2

(12) United States Patent
Schwartzbart et al.

(10) Patent No.: US 7,402,045 B2
(45) Date of Patent: Jul. 22, 2008

(54) ELECTRICAL INTERCONNECTION HAVING MAGNETIC CONDUCTIVE ELEMENTS

(75) Inventors: Aaron Schwartzbart, Winnetka, CA (US); Dale O. Cipra, Chatsworth, CA (US)

(73) Assignee: United Technologies Corporation, Hartford, CT (US)

( * ) Notice: Subject to any disclaimer, the term of this patent is extended or adjusted under 35 U.S.C. 154(b) by 80 days.

(21) Appl. No.: 11/523,854

(22) Filed: Sep. 20, 2006

(65) Prior Publication Data

US 2008/0067044 A1 Mar. 20, 2008

(51) Int. Cl.
*H01R 11/30* (2006.01)

(52) U.S. Cl. ..... 439/38; 439/39

(58) Field of Classification Search ..... 439/38, 439/39, 40

See application file for complete search history.

(56) References Cited

U.S. PATENT DOCUMENTS

| | | | | |
|---|---|---|---|---|
| 3,521,216 | A * | 7/1970 | Tolegian | 439/39 |
| 4,844,582 | A * | 7/1989 | Giannini | 385/57 |
| 5,401,175 | A * | 3/1995 | Guimond et al. | 439/38 |
| 7,264,479 | B1 * | 9/2007 | Lee | 439/39 |

* cited by examiner

*Primary Examiner*—Tho D. Ta
*Assistant Examiner*—Travis Chambers
(74) *Attorney, Agent, or Firm*—Kinney & Lange, P.A.

(57) ABSTRACT

An electrical interconnection comprises a first magnetic conductor and a second magnetic conductor. The second magnetic conductor is magnetically attracted to the first magnetic conductor to establish an electrical conductive path between the first and second magnetic conductors.

16 Claims, 7 Drawing Sheets

ELECTRICAL INTERCONNECTION HAVING MAGNETIC CONDUCTIVE ELEMENTS

BACKGROUND OF THE INVENTION

The present invention relates generally to a system for electrically connecting components. More particularly, the present invention relates to an electrical interconnection configured to magnetically couple two or more conductive elements together to establish an electrical conductive path between the conductive elements.

In the past, the simplest way to provide electrical power to a component or to receive electrical signal from a component was to connect a power source to the component with a conductive wire. One of the most common types of conductive wires is a copper wire. In many instances, these conductive wires are coated with a material that functions to both protect and insulate the wire. Conductive wires are manufactured in numerous "gauges" so that an appropriately sized wire may be selected for a specific application.

Typical conductive wires are relatively stiff and are not designed to stretch when a tensile force is applied to the wire. Tensile forces are common when the wire is used in conjunction with a component that experiences vibration. Thus, wires that experience tensile forces have a tendency to snap in half when stretched, thereby destroying their use as an electrical conductive path. Furthermore, the stiffness and thermal contraction properties of the materials used to support or insulate the wire become a greater problem when the wire is used in a cold environment where the materials may become brittle and possibly shrink. It is not uncommon in these situations for the materials themselves to shear the wire, thereby destroying the conductive path. Conductive elements such as conductive wire braids have been developed which have the ability to stretch more than an ordinary strand of wire. However, the amount that the conductive wire braids may stretch is still rather limited.

Thus, there exists a need for an electrical interconnection with increased versatility that is capable of providing an electrical conductive path under a wide range of operating conditions.

BRIEF SUMMARY OF THE INVENTION

The present invention is an electrical interconnection comprising a first magnetic conductor and a second magnetic conductor. The second magnetic conductor is magnetically attracted to the first magnetic conductor to establish an electrical conductive path between the first and second magnetic conductors.

DETAILED DESCRIPTION

Figure 1:
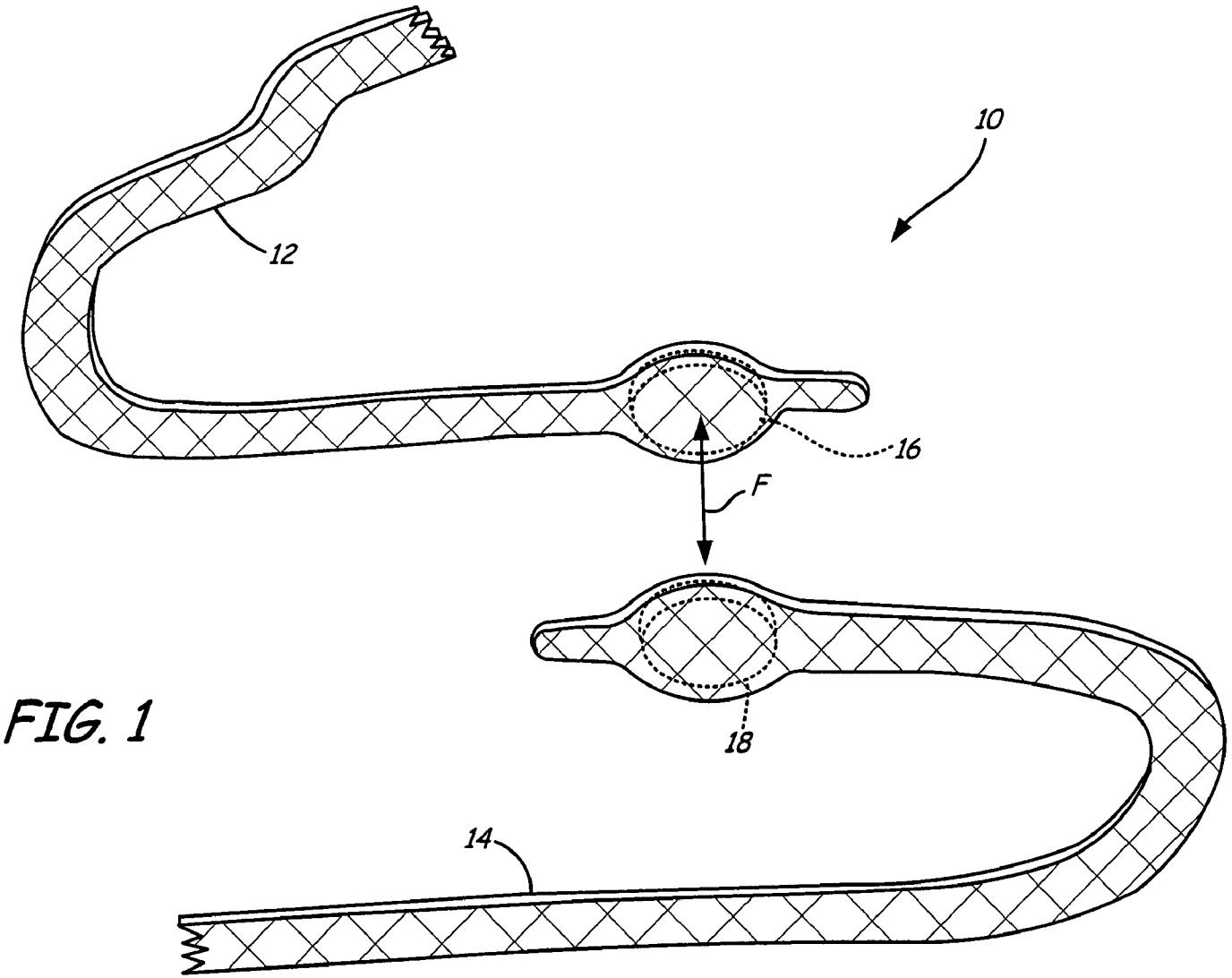
FIG. 1 is a diagram illustrating an electrical interconnection of the present invention, which includes a first conductive element and a second conductive element.

FIG. 1 is a diagram illustrating electrical interconnection 10, which includes first conductive element 12, second conductive element 14, first magnetic element 16, and second magnetic element 18. As shown in FIG. 1, first magnetic element 16 is disposed within first conductive element 12, while second magnetic element 18 is disposed within second conductive element 14, as depicted by the broken-line outlines of the magnetic elements.

When opposite poles of first and second magnetic elements 12 and 14 are placed close to one another, a magnetic attraction F forms between the two magnetic elements. As will be described in more detail to follow, when first and second magnetic elements 16 and 18 are magnetically coupled together, an electrical conductive path is formed between first conductive element 12 and second conductive element 14. Thus, when magnetically coupled together, first and second conductive elements 12 and 14 form a single electrically conductive element capable of transferring an electrical current.

In one embodiment, first and second magnetic elements 16 and 18 may both be permanent magnets (i.e., a ferromagnetic material which has a significant retained magnetization). One example of a permanent magnet is a rare earth magnet. In other embodiments, one of the magnetic elements may be a paramagnetic or ferromagnetic type material that does not have the retained magnetization like a permanent magnet, but becomes magnetized when placed near a magnetic field.

Electrical interconnection 10 is useful in any application where an electrical connection between two components is required, and may replace prior art conductive wires commonly used to provide an electrical conductive path between components. Particularly, the electrical interconnection of the present invention is useful in applications where conductive wires may be subject to very low temperatures, extreme vibration, or tensile forces that may cause the wires to break or become damaged.

In the embodiment illustrated in FIG. 1, first and second conductive elements 12 and 14 are conductive braids, and first and second magnetic elements 16 and 18 are disposed within their respective conductive braids. However, in other embodiments, first and second magnetic elements 16 and 18 may alternatively be coupled to an outer surface of their respective conductive element. In addition, although conductive elements 12 and 14 are shown as each having one associated magnetic element, a plurality of magnetic elements may be used without departing from the intended scope of the present invention.

The magnetic force of attraction F between first and second magnetic elements 16 and 18 provides a "quick disconnect" feature that is useful to quickly and easily interrupt the flow of current from one conductive element to the other. In particular, the electrical conductive path may be interrupted by separation of first and second magnetic elements 16 and 18. This may be accomplished by simply pulling magnetic elements 16 and 18 in opposite directions along the F-axis until first and second conductive elements 12 and 14 are no longer in contact. As a result, when first and second conductive elements 12 and 14 are no longer in contact, and electrical current cannot pass between them. For example, if electrical interconnection 10 is used to provide power to a sensor, the magnetic elements serve as a means to quickly disconnect (and re-connect) power to the sensor.

It is important to note that in order for the magnetic attraction F between first and second magnetic elements 16 and 18 to exist, the temperature of first and second conductive elements 12 and 14 must remain below the Curie temperature of both magnetic elements 16 and 18. If the temperature of a conductive element exceeds the Curie temperature of its associated magnetic element, then the magnetic element will begin to lose any retained magnetization. As a result, the electrical conductive path may be broken due to the lack of a magnetic attraction between the magnetic elements.

Figure 2A:
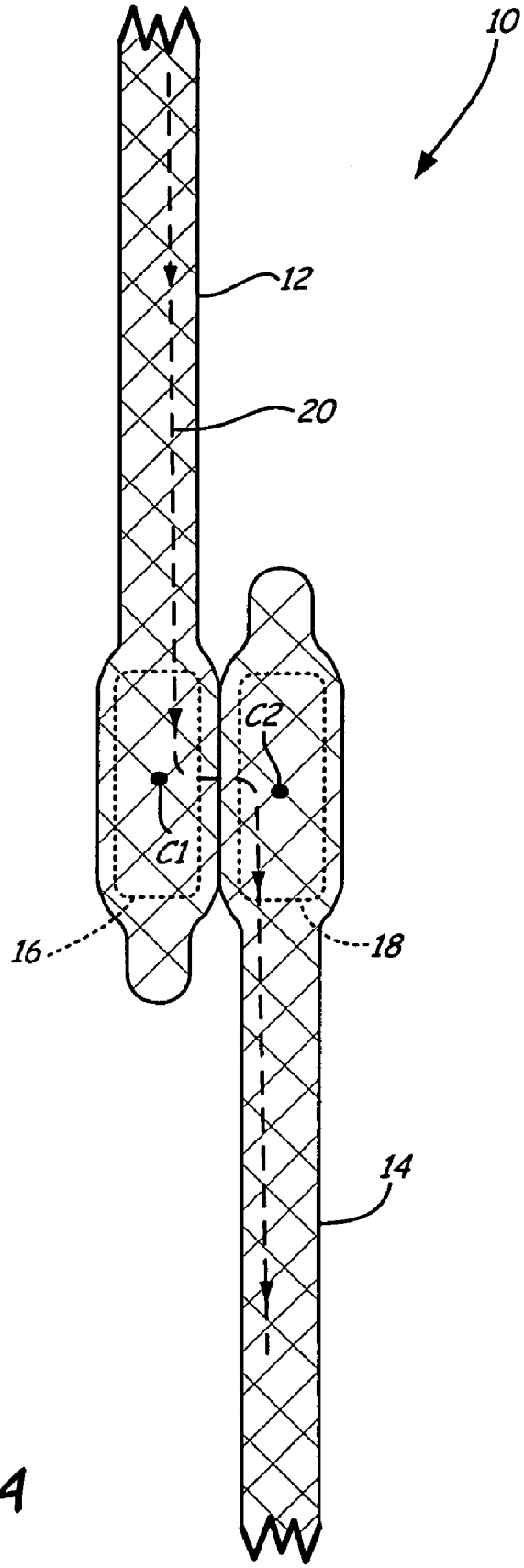
FIGS. 2A and 2B are diagrams illustrating how the electrical interconnection of the present invention is configured to provide strain relief when a force, such as a tensile force, is applied to the first or second conductive elements.
Figure 2B:
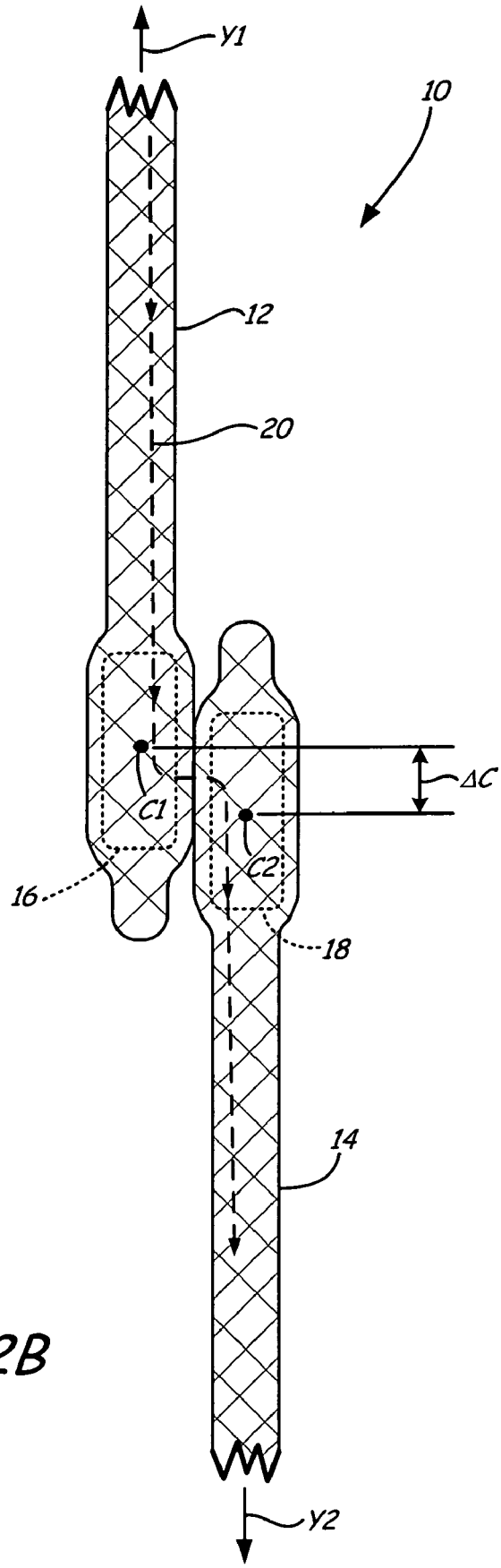

FIGS. 2A and 2B illustrate how the electrical interconnection of the present invention provides strain relief when a force, such as a tensile force, is applied to one or both of conductive elements 12 and 14. First, as shown in FIG. 2A, no tensile force is applied to either of the conductive elements, and center point C1 of first magnetic element 16 is aligned with center point C2 of second magnetic element 18. As illustrated in FIG. 2A, an electrical conductive path 20 is defined by the overlapping surface lengths of first and second magnetic elements 16 and 18.

Next, as shown in FIG. 2B, a tensile force has now been applied to first conductive element 12 in direction Y1 and second conductive element 14 in direction Y2. These tensile forces have caused center point C1 of first magnetic element 16 to slide in direction Y1 and center point C2 of second magnetic element 18 to slide in direction Y2, thereby creating a separation ΔC between center points C1 and C2. The separation ΔC illustrates the strain relief element of the present invention, which exists due to the fact that first and second conductive elements 12 and 14 may be pulled apart in an axial direction relative to one another without losing electrical conductive path 20. In particular, when a tensile force is applied to first and second conductive elements 12 and 14, the magnetic attraction formed between first and second magnetic elements 16 and 18 allows the conductive elements to slide relative to one another while maintaining the electrical conductive path 20. It should be noted that the amount that first and second conductive elements 12 and 14 may slide relative to one another is related to the lengths, placement, and number of magnetic elements associated with each conductive element. For example, the longer the magnetic regions of first and second conductive elements 12 and 14, the more they may be pulled relative to one another without losing the electrical conductive path 20 formed between them.

Figure 3:
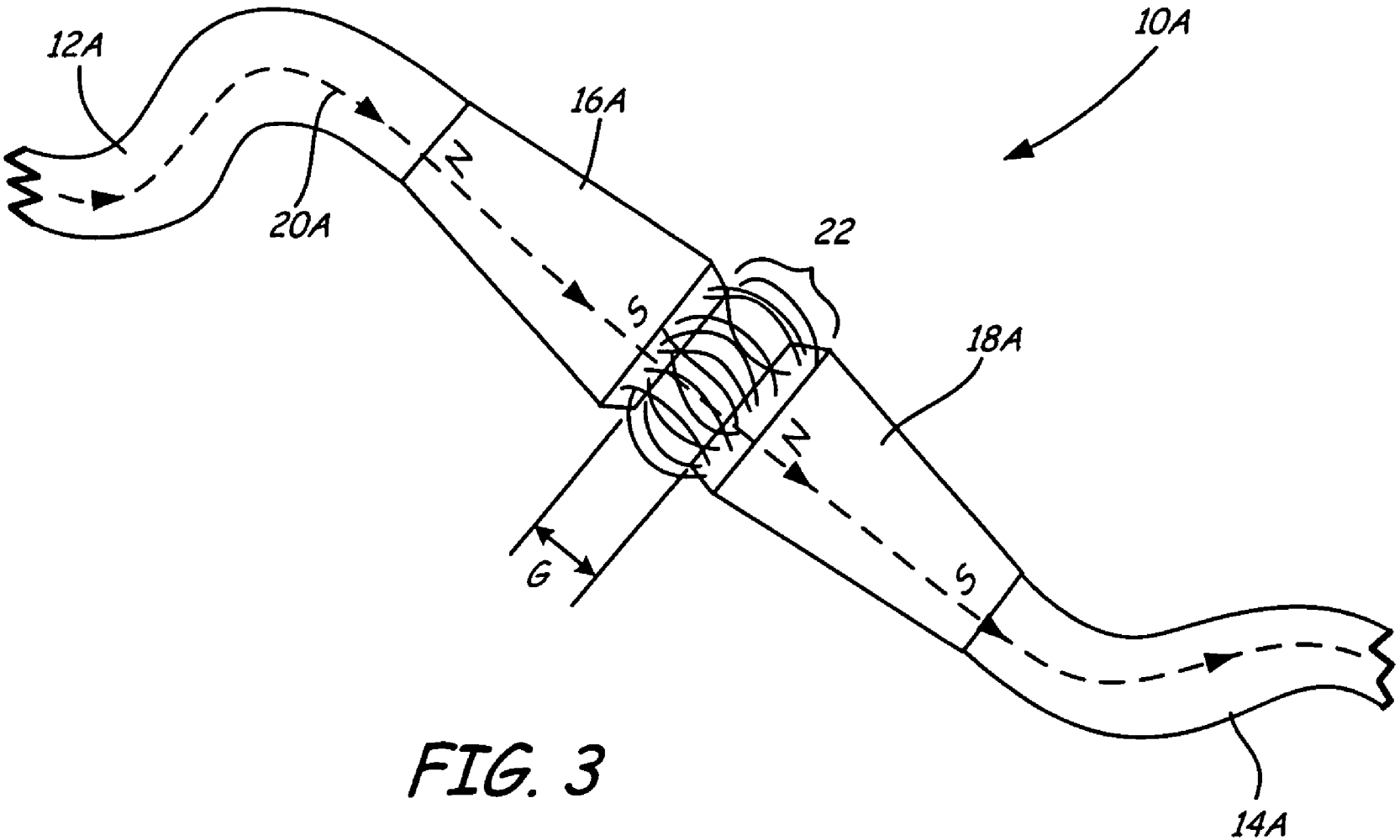
FIG. 3 is a diagram illustrating a first alternative embodiment of the electrical interconnection of FIG. 1.

FIG. 3 is a diagram illustrating electrical interconnection 10A, which is a first alternative embodiment of electrical interconnection 10. As illustrated in FIG. 3, electrical interconnection 10A includes first conductive element 12A, second conductive element 14A, first magnetic element 16A, and second magnetic element 18A. Electrical interconnection 10A is similar to electrical interconnection 10. However, first and second magnetic elements 16 and 18, which are themselves also conductive, are coupled to an outer surface of their respective conductive elements, and a plurality of magnetic conductive slivers 22 is disposed between the magnetic elements. Magnetic conductive slivers 22 are configured to maintain electrical conductive path 20A between first and second conductive elements 12A and 14A when first and second magnetic elements 16A and 18A are separated, creating gap G between the conductive elements. In fact, the addition of magnetic conductive slivers 22 yields another example of a strain relief element since first and second conductive elements 12A and 14A may be pulled apart without breaking electrical conductive path 20A.

When first and second magnetic elements 16A and 18A are pulled apart, a north pole "N" of each magnetic conductive sliver 22 aligns with a south pole "S" of either first magnetic element 16A or another magnetic conductive sliver 22. Similarly, a south pole "S" of each magnetic conductive sliver 20 aligns with a north pole "N" of either second magnetic element 18A or another one of the magnetic conductive slivers 22. It should be noted that due to the small size of magnetic conductive slivers 22, the north and south poles of slivers 22 are not labeled in FIG. 3. Magnetic conductive slivers 22 are able to maintain electrical conductive path 20A between first and second conductive elements 12A and 14A due to the magnetic attraction (i.e., the magnetic flux) present between first and second magnetic elements 16A and 18A. It is important to note that as the gap G between first and second magnetic elements 16A and 18A increases, the magnitude of the magnetic force of attraction between the magnetic elements decreases. Therefore, once gap G is large enough that the magnetic force of attraction weakens significantly, magnetic conductive slivers 22 will no longer be able to complete the electrical conductive path and current will no longer flow between first and second conductive elements 12A and 14A.

The slivers were referred to as "conductive magnetic slivers" above to indicate that in order for the slivers to conduct current, they must be both conductive as well as magnetic or ferromagnetic. Therefore, slivers 22 may be formed from a magnetic material and coated with, among other materials, copper or gold, in order to achieve both properties. However, any type of sliver that is both magnetic (or ferromagnetic) and conductive, whether manufactured with a conductive coating or not, is within the intended scope of the present invention.

Figure 4:
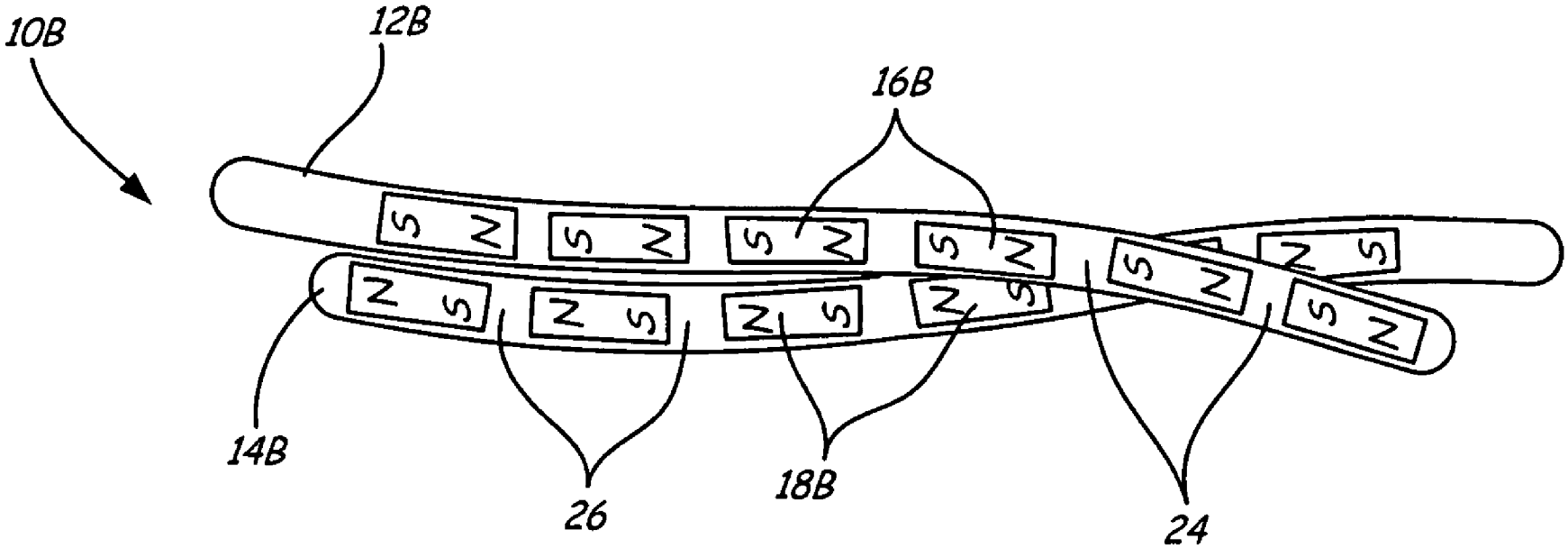
FIG. 4 is a diagram illustrating a second alternative embodiment of the electrical interconnection of FIG. 1.

FIG. 4 is a diagram illustrating electrical interconnection 10B, which is a second alternative embodiment of electrical interconnection 10. Electrical interconnection 10B includes first conductive element 12B, second conductive element 14B, a first plurality of magnetic elements 16B, and a second plurality of magnetic elements 18B. In particular, as shown in FIG. 4, first conductive element 12B is a cylindrically shaped tube having conductive properties, while magnetic elements 16B are cylindrically shaped magnets sized so as to fit within inner, hollow portions of first conductive element 12B. In between each pair of magnetic elements 16B are conductive spacers 24 configured to space apart magnetic elements 16B at defined increments while providing a plurality of additional conductive passages within first conductive element 12B. Similarly, second conductive element 14B is a cylindrically shaped tube having conductive properties, while magnetic elements 18B are cylindrically shaped magnets sized so as to fit within inner, hollow portions of second conductive element 14B. In between each pair of magnetic elements 18B are conductive spacers 26 configured to space apart magnetic elements 18B at defined increments while providing a plurality of additional conductive passages within second conductive element 14B. As shown in FIG. 4, first and second conductive elements 12B and 14B overlap each other, and a conductive path is formed between the two conductive elements at every point of contact between the outer surfaces of first and second conductive elements 12B and 14B.

Magnetic elements 16B and 18B provide a magnetic force of attraction to magnetically couple first conductive element 12B to second conductive element 14B so that an electrical conductive path exists between the two conductive elements. In particular, as illustrated in FIG. 4, a north pole "N" on each magnet 16B aligns with a south pole "S" on a corresponding magnet 18B to magnetically couple first and second conductive elements 12B and 14B to form the electrical conductive path.

It should be noted that depending on the particular use of electrical interconnection 10B, the length of magnetic elements 16B and 18B as well as conductive spacers 24 and 26 may be varied to adjust the locations of the magnetic regions within conductive elements 12B and 14B. For instance, the lengths of conductive spacers 24 and 26 may be decreased such that magnetic elements 16B and 18B are spaced closer together along the longitudinal length of the conductive elements. In addition, although conductive elements 12B and 14B and magnetic elements 16B and 18B were described as being cylindrically shaped, conductive and magnetic elements having various other shapes, orientations, and distributions of the "N" and "S" poles are within the intended scope of the present invention.

Figure 5:
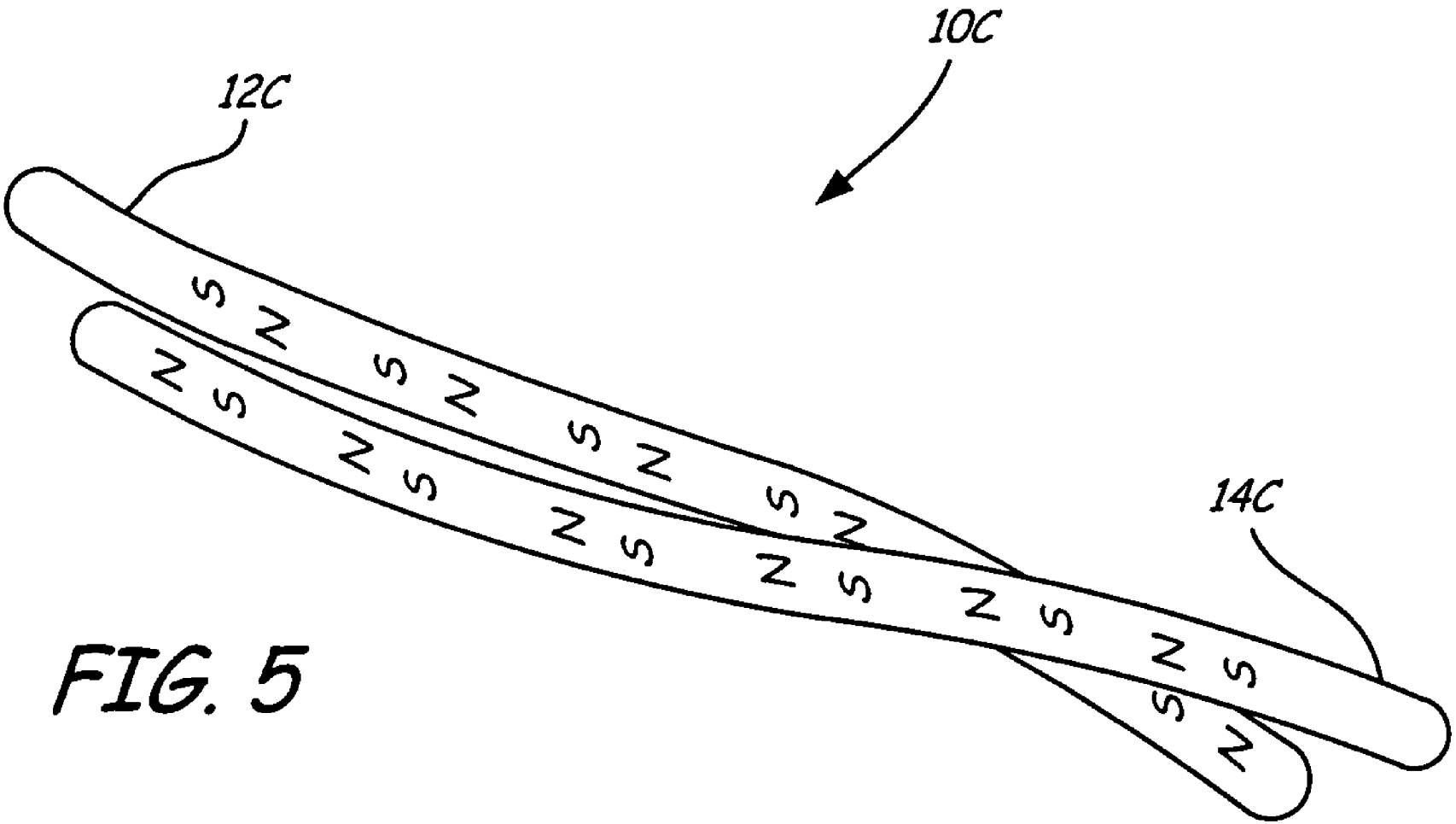
FIG. 5 is a diagram illustrating a third alternative embodiment of the electrical interconnection of FIG. 1.

FIG. 5 is a diagram illustrating electrical interconnection 10C, which is a third alternative embodiment of electrical interconnection 10. Electrical interconnection 10C includes first conductive element 12C and second conductive element 14C. Conductive elements 12C and 14C each include a plurality of microscopic magnetic particles disposed within them, thereby making the conductive elements themselves appear to have magnetic properties. Although the microscopic magnetic elements cannot be seen, the effect they have on first and second conductive elements 12C and 14C is illustrated by the placement of poles "N" and "S" throughout an interior portion of first and second conductive elements 12C and 14C in FIG. 5.

In one embodiment, first and second conductive elements 12C and 14C are formed by melting a conductive material, mixing in the microscopic magnetic particles, allowing the mixture of magnetic, conductive material to harden, and drawing the material into thin wire strands. The strands are then exposed to a magnetic field to impart a significant retained magnetization to the microscopic magnetic particles so that they will behave as microscopic permanent magnets. As a result, the conductive elements themselves will appear to be permanent magnets. Strategic design of the magnetic field used to impart the retained magnetization allows control of the magnetization along the conductor length. For example, conductive elements 12C and 14C may be "magnetized" to have a substantially uniform magnetization along their length. The magnetic force of attraction allows first and second conductive elements 12C and 14C to be wound tightly together to increase the contact area, and thus the conductive path, between the conductive elements. In addition, the substantially uniform magnetic attraction along the length of first and second conductive elements 12C and 14C allows the conductive elements to slide relative to one another while maintaining the conductive path between the conductive elements. In particular, the more first conductive element 12C is wound around and overlapped with second conductive element 14C, the better electrical interconnection 10C will be capable of handling tensile strains or forces that cause longitudinal movement of the conductive elements. Furthermore, even if placed in an environment with extreme vibration levels large enough to cause a separation of first and second conductive elements 12C and 14C at one or more locations, the magnetic force of attraction is configured to pull first and second conductive elements 12C and 14C back so that they once again make contact and form the electrical conductive path.

Figure 6:
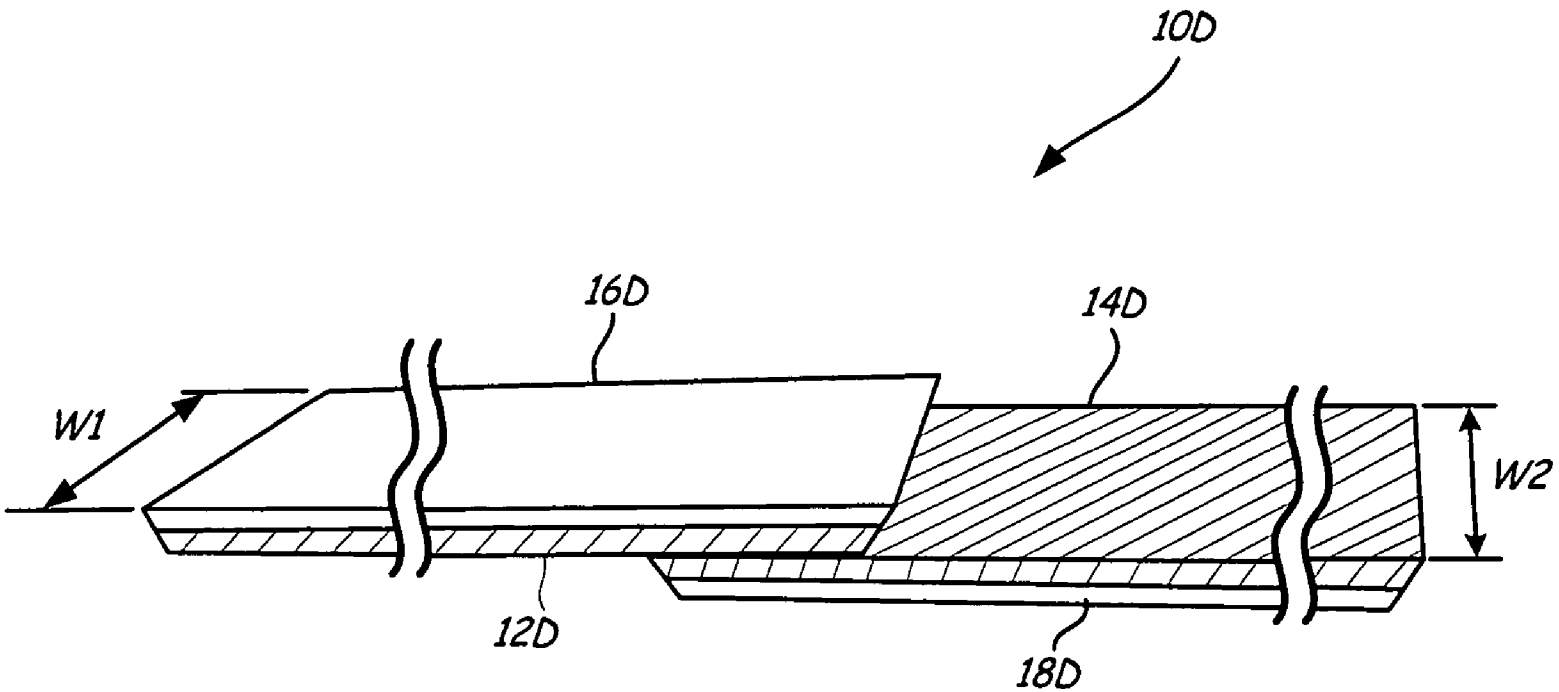
FIG. 6 is a diagram illustrating a fourth alternative embodiment of the electrical interconnection of FIG. 1.

FIG. 6 is a diagram illustrating electrical interconnection 10D, which is a fourth alternative embodiment of electrical interconnection 10. Electrical interconnection 10D includes first conductive element 12D, second conductive element 14D, first magnetic element 16D, and second magnetic element 18D. The embodiments of the electrical interconnection of the present invention described above each included conductive elements that were in the form of a conductive wire or conductive braid. However, as illustrated in FIG. 6, first and second conductive elements 12D and 14D are conductive strips of material having rectangular cross-sections and widths W1 and W2, respectively. Widths W1 and W2 may be sized according to the specific needs of a particular application. Thus, if it is desirable to increase the contact area between the conductive elements, widths W1 and W2 may be increased. Another advantage of the conductive strip-type conductive element is that the strips may be created in any desired shape or design.

First and second conductive elements 12D and 14D are preferably formed from a thin, conductive foil-type material. First and second magnetic elements 16D and 18D are preferably formed from microscopic magnetic particles suspended in a flexile polymer sheet. The magnetic elements may be bonded to their respective conductive elements by a bonding means such as an adhesive.

As shown in FIG. 6, when magnetically coupled together, first conductive element 12D and second conductive element 14D are in direct contact and form an electrical conductive path between the two conductive elements. In this embodiment, first and second magnetic elements 16D and 18D do not directly contact one another. Instead, the magnetic force of attraction formed between first and second magnetic elements 16D and 18D is strong enough to magnetically hold first and second conductive elements 12D and 14D in a sandwich-like configuration with the outer surfaces of the conductive elements overlapping.

It should be understood that various other embodiments consistent with the details described above are possible and within the intended scope of the present invention. Thus, the embodiments illustrated in FIGS. 1-6 are shown merely for purposes of example and not for limitation. In addition, although the various embodiments were described above as including two conductive elements, embodiments of the electrical interconnection that include any number of separate conductive elements are contemplated.

Although the present invention has been described with reference to preferred embodiments, workers skilled in the art will recognize that changes may be made in form and detail without departing from the spirit and scope of the invention.

The invention claimed is:

1. An electrical interconnection comprising:

a first electrically conductive wire braid;

a first magnet disposed within the first electrically conductive wire braid;

a second electrically conductive wire braid; and a second magnet disposed within the second electrically conductive wire braid, the second magnet magnetically attracted to the first magnet to establish an electrical conductive path between the first electrically conductive wire braid and the second electrically conductive wire braid.

2. The electrical interconnection of claim 1, wherein the magnetic regions of the first and second magnets each include a plurality of magnetic elements.

3. The electrical interconnection of claim 1, wherein the first and second magnets are positioned so that the first electrically conductive wire braid may slide relative to the second electrically conductive wire braid while maintaining the electrical conductive path between the first and second electrically conductive wire braids.

4. The electrical interconnection of claim 1, wherein the first magnet exhibits a retained magnetization.

5. The electrical interconnection of claim 4, wherein the second magnet exhibits a retained magnetization.

6. A system for providing an electrical connection comprising:

a first flexible conductive element having a first free end with a first sidewall;

a second flexible conductive element having second free end with a second sidewall; and first and second magnetic elements embedded in the first and second flexible conductive elements adjacent the first and second sidewalls, respectively, for producing a magnetic attraction to magnetically couple the first sidewall of the first flexible conductive element to the second sidewall of the second flexible conductive element to form an electrical connection between the first and second flexible conductive members.

7. The system of claim 6, wherein the magnetic attraction creates a magnetic field perpendicular to the first sidewall and the second sidewall.

8. The system of claim 6, wherein the magnetic attraction produced by the first and second magnetic elements allows the first flexible conductive element to slide along an outer surface of the second flexible conductive element while maintaining the electrical connection between the first and second flexible conductive elements.

9. The system of claim 6, wherein the first magnetic element exhibits a retained magnetization.

10. The system of claim 9, wherein the second magnetic element exhibits a retained magnetization.

11. The system of claim 10, wherein the first and second magnetic elements are rare earth magnets.

12. The system of claim 10, and further comprising a plurality of conductive slivers disposed between the first and second magnetic elements and configured to maintain the electrical connection between the first and second flexible conductive elements when the first magnetic element is separated from the second magnetic element.

13. An electrical interconnection comprising: disposed within the first electrically conductive braid a first electrically conductive braid a magnetic region disposed within the first electrically conductive braid adjacent a first sidewall of a first free end; and a second electrically conductive braid a magnetic region disposed within the second electically conductive braid adjacent a second sidewall of a second free end, wherein the magnetic regions of the first and second electrically conductive braids are configured to magnetically couple the first and second free ends together to form an electrical conductive path between the first and second conductive braids.

14. The electrical interconnection of claim 13, wherein the magnetic regions of the first and second electrically conductive braids are configured to allow the first electrically conductive braid to slide relative to the second electrically conductive braid while maintaining the electrical conductive path between the first and second electrically conductive braids.

15. The electrical interconnection of claim 13, wherein the magnetic regions of the first and second electrically conductive braids comprise at least one magnet.

16. The electrical interconnection of claim 15, wherein the magnets are permanent magnets.

* * * * *

UNITED STATES PATENT AND TRADEMARK OFFICE

CERTIFICATE OF CORRECTION

PATENT NO. : 7,402,045 B2
APPLICATION NO. : 11/523854
DATED : July 22, 2008
INVENTOR(S) : Aaron Schwartzhbart et al.

It is certified that error appears in the above-identified patent and that said Letters Patent is hereby corrected as shown below:

Column 8, Line 5, delete "comprising disposed within the first electrically conductive braid", insert --comprising--

Signed and Sealed this

Eighteenth Day of May, 2010

David J. Kappos

David J. Kappos
*Director of the United States Patent and Trademark Office*